US006540553B1

(12) United States Patent
Wu

(10) Patent No.: US 6,540,553 B1
(45) Date of Patent: Apr. 1, 2003

(54) ELECTRICAL CONNECTOR HAVING BOARD LOCKS

(75) Inventor: Jerry Wu, Pan-Chiao (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/071,551

(22) Filed: Feb. 8, 2002

(51) Int. Cl.[7] ..... H01R 13/73
(52) U.S. Cl. ..... 439/567
(58) Field of Search ..... 439/567, 571, 439/573, 570

(56) References Cited

U.S. PATENT DOCUMENTS 5,951,325 A * 9/1999 Tang et al. ..... 439/567
6,024,602 A * 2/2000 Mchugh et al. ..... 439/567
6,086,418 A * 7/2000 Chang ..... 439/573
6,190,201 B1 * 2/2001 Shih et al. ..... 439/567
6,471,544 B1 * 10/2002 Huang ..... 439/567

* cited by examiner

*Primary Examiner*—Hien Vu
(74) *Attorney, Agent, or Firm*—Wei Te Chung

(57) ABSTRACT

An electrical connector (10) comprises a housing (20) defining a mating port and a pair of side portions (24), a plurality of terminals (30) received in the mating port, and a pair of board locks (40) assembled in the side portions. Each side portion has a receiving space (240) extending along the mating direction and two shoulder portions (243) around the receiving space. The receiving space is divided into a first receiving part (241) and a second receiving part (242) by the two shoulder portions and communicating with each other. Each board lock is assembled into the receiving space. The board lock comprises a base portion (41) received in the first receiving part, a pair of resilient latch portions (42) extending from the base portion into the second receiving part to abut against the shoulder portions, and a pair of leg portions (43) extending outside the side portion.

2 Claims, 7 Drawing Sheets

ELECTRICAL CONNECTOR HAVING BOARD LOCKS

BACKGROUND OF THE INVENTION

1. Field of the Invention

The present invention relates to an electrical connector, and particularly to the electrical connector having board locks.

2. Description of Related Art

In the prior art, a DIN connector has an insulative housing, a plurality of terminals received in the housing, and a pair of board locks mounted to the housing. The housing has a mating port defined in a horizontal direction and a pair of side portions. Each side portion defines a through hole extending in a vertical direction to receive the board lock therein. An open mold direction of a first mold forming the mating port of the housing is in a horizontal direction, and an open mold direction of a second mold forming the through hole of the housing is in a vertical direction, the structures of the molds in multi-open directions are complex. An additional wedge-shaped slide mold is introduced to work together with the second mold to help the second mold being moved vertically. When the first mold and the wedge-shaped slide mold are moved together away the housing in the horizontal direction, the second mold climbs up the wedge-shaped slide mold till a post extending from the wedge-shaped slide mold and ejecting the second mold out the side portion of the housing. Because the wedge-shaped slide mold is added, the whole height of the molds increases. It is required to decrease the whole height of the molds by changing the open mold direction of the second mold to remove the wedge-shaped slide mold.

SUMMARY OF THE INVENTION

Accordingly, one object of the present invention is to provide an electrical connector having simple structures of molds forming the connector.

Another object of the present invention is to provide the electrical connector having board locks assembled to a housing of the connector securely.

In order to achieve the objects set forth, an electrical connector comprises an insulative housing defining a mating port along a mating direction and a pair of side portions at a pair of ends of the mating port, a plurality of terminals received in the mating port, and a pair of board locks assembled in the side portions. Each side portion of the housing has a receiving space extending along the mating direction and two shoulder portions around the receiving space. The receiving space is divided into a first receiving part and a second receiving part by the two shoulder portions and the first receiving part communicates with the second receiving part. Each board lock is assembled into the receiving space. The board lock comprises a base portion received in the first receiving part, a pair of resilient latch portions extending from the base portion into the second receiving part to abut against the shoulder portions thereby preventing the board lock from moving rearwardly, and a pair of leg portions extending outside the side portion of the housing.

Other objects, advantages and novel features of the invention will become more apparent from the following detailed description when taken in conjunction with the accompanying drawings.

DETAILED DESCRIPTION OF THE INVENTION

Figure 1:
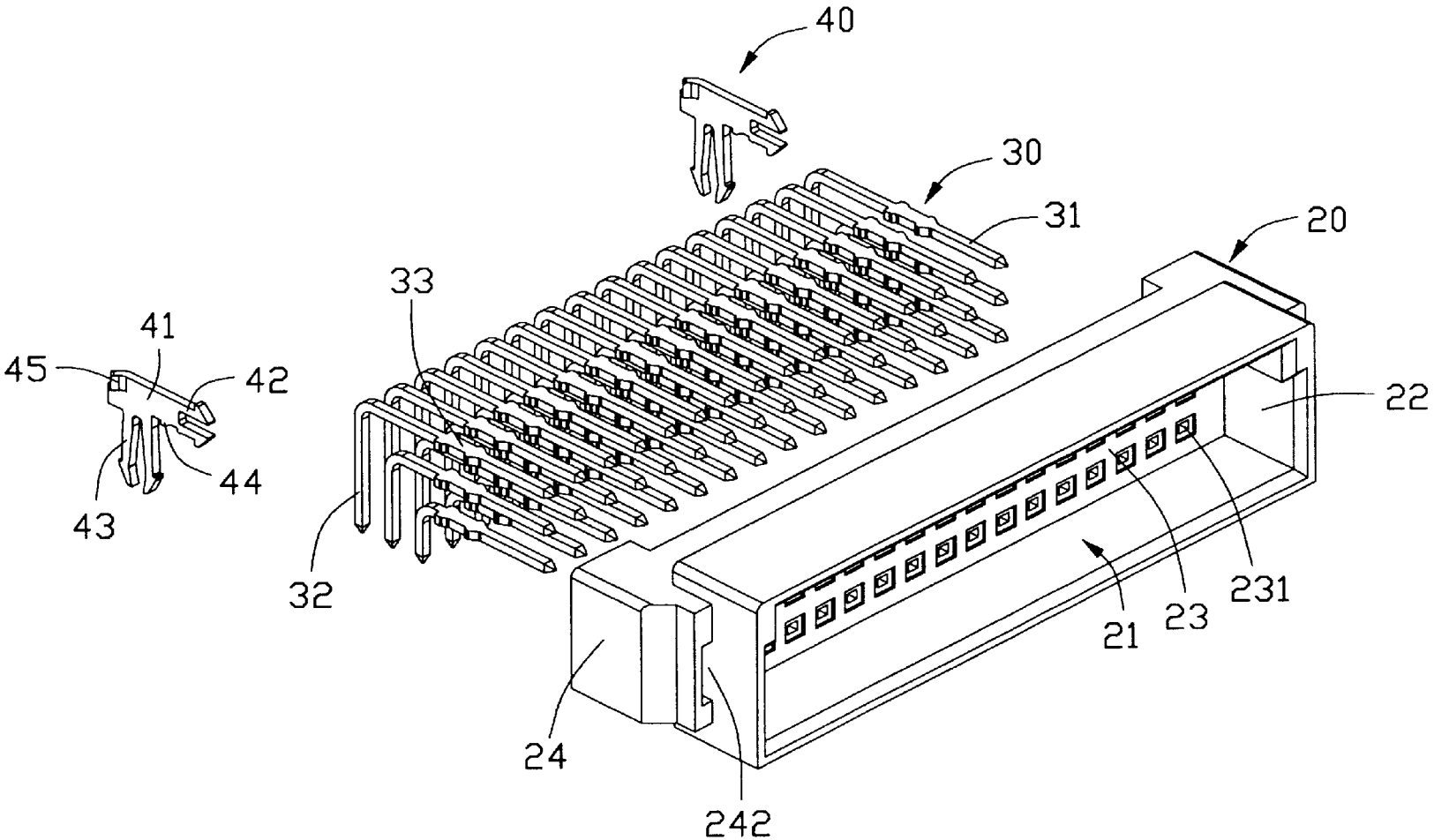
FIG. 1 is an exploded view of an electrical connector.
Figure 2:
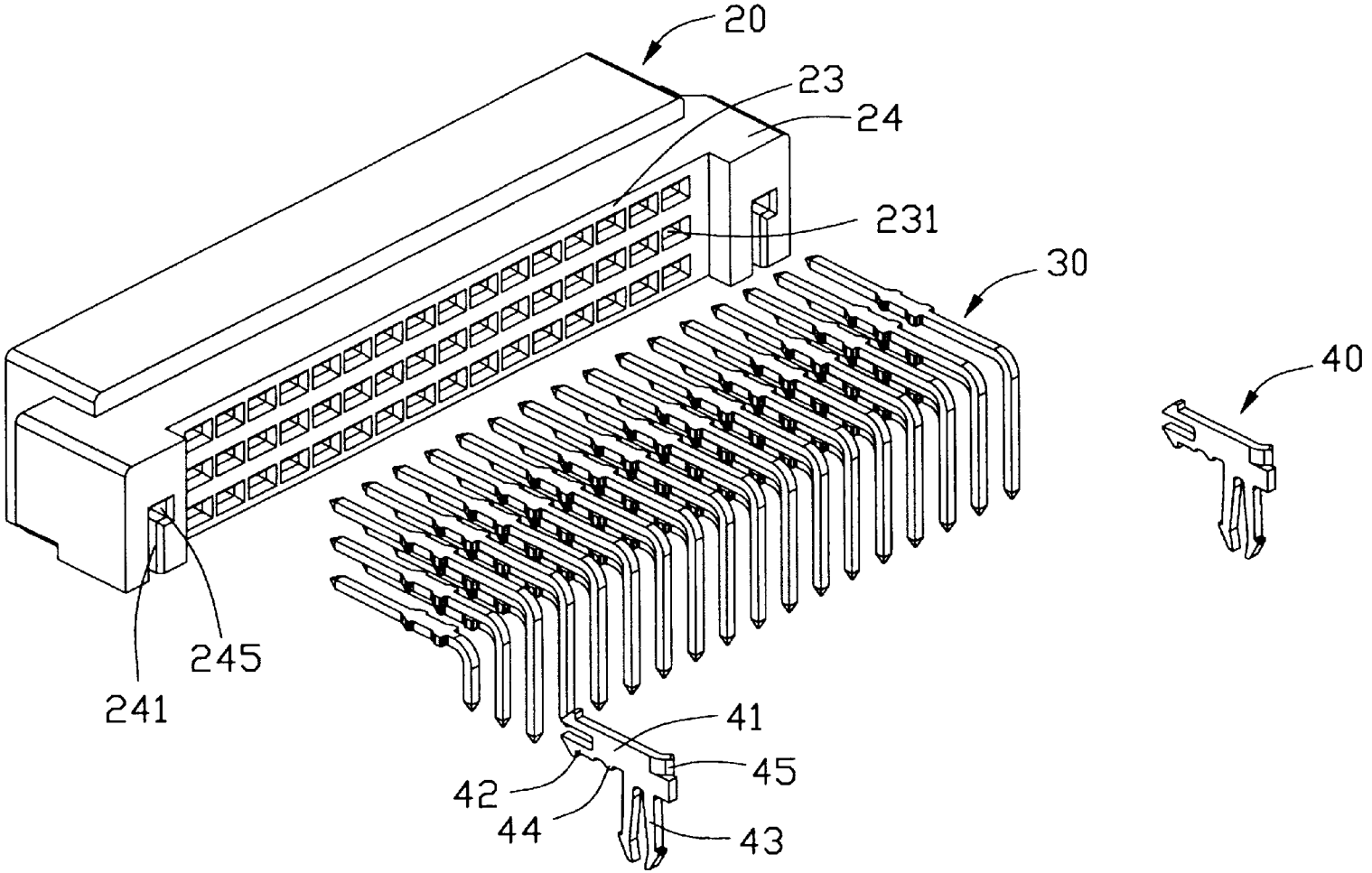
FIG. 2 is an exploded view of the electrical connector in another angle.
Figure 3:
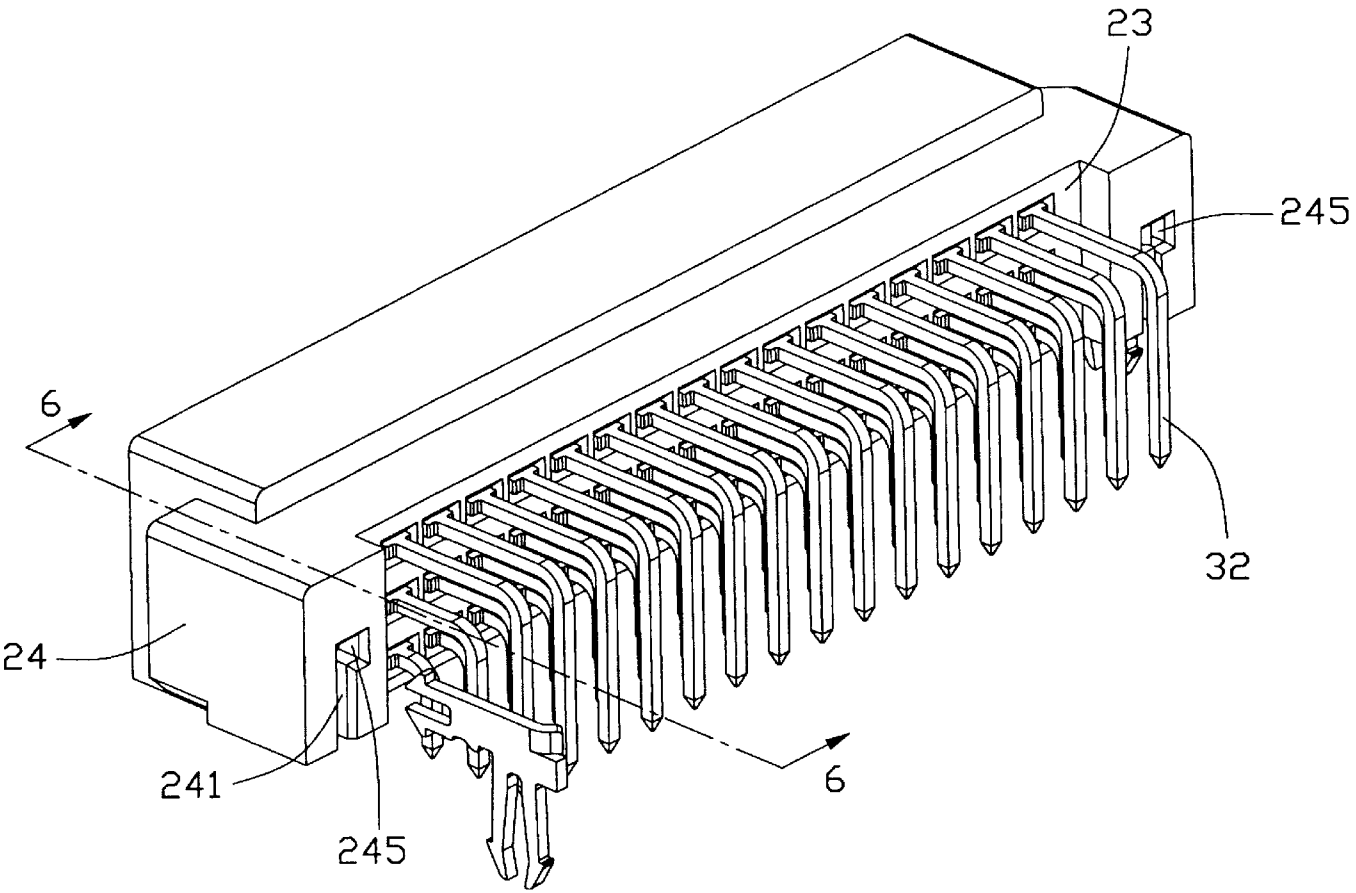
FIG. 3 is a partly assembled view of the electrical connector of FIG. 2.
Figure 4:
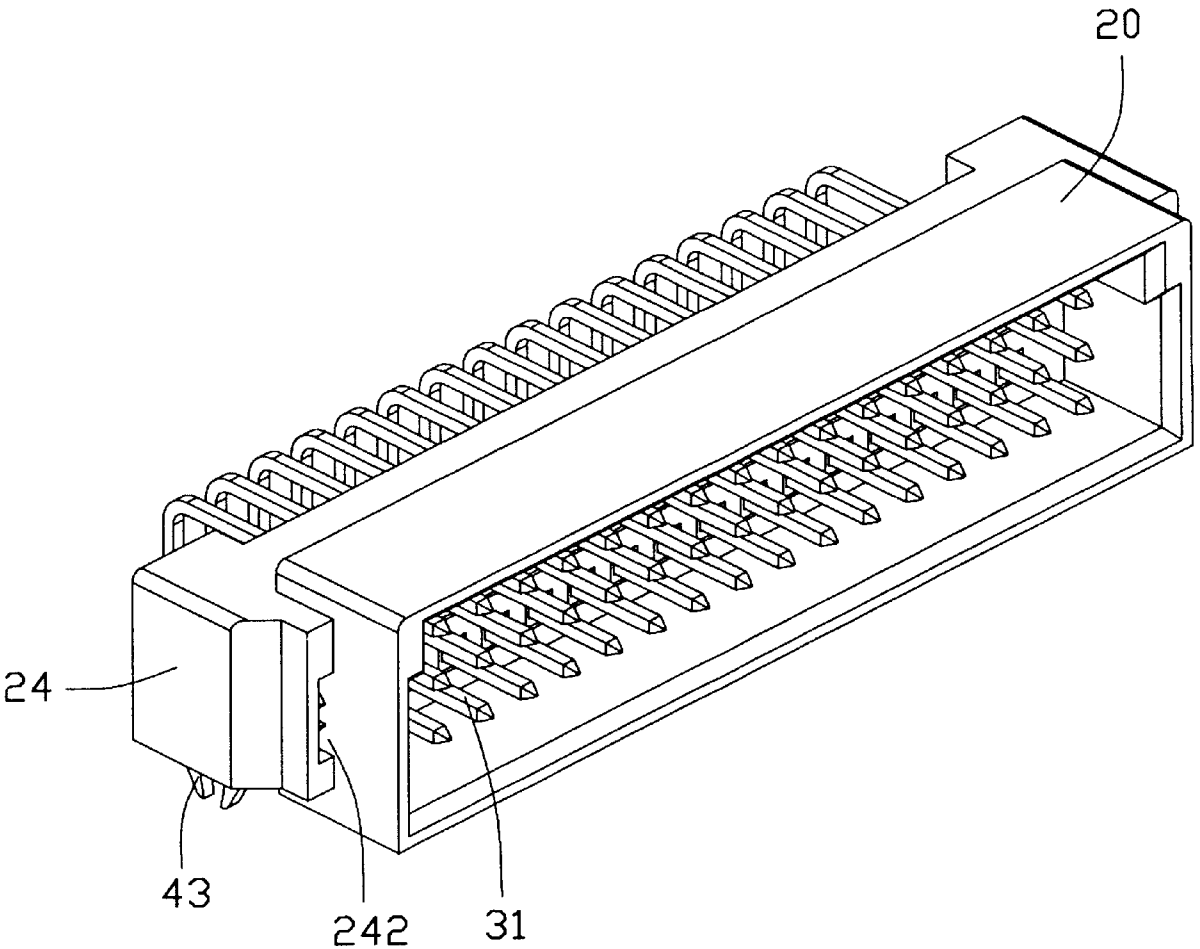
FIG. 4 is an assembled view of the electrical connector of FIG. 1.

Referring to FIGS. 1 and 2, an electrical connector 10 comprises an insulative housing 20, a plurality of terminals 30, and a pair of board locks 40.

The insulative housing 20 comprises a mating port 21 defined along a mating direction from a mating face 22 to a rear wall 23 of the housing and a pair of side portions 24. A plurality of passageways 231 is defined in the rear wall 23.

Figure 5:
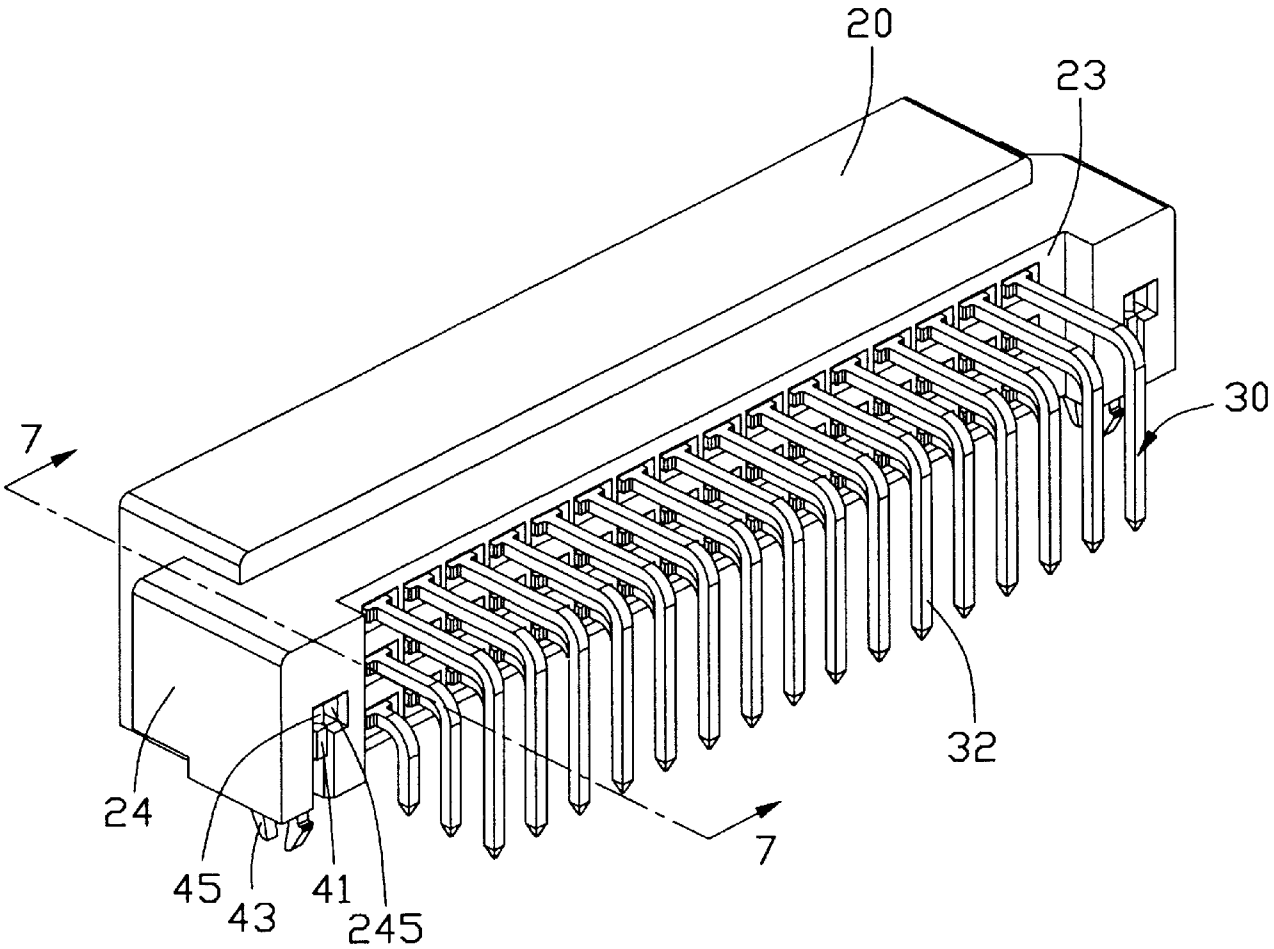
FIG. 5 is an assembled view of the electrical connector of FIG. 3.
Figure 6:
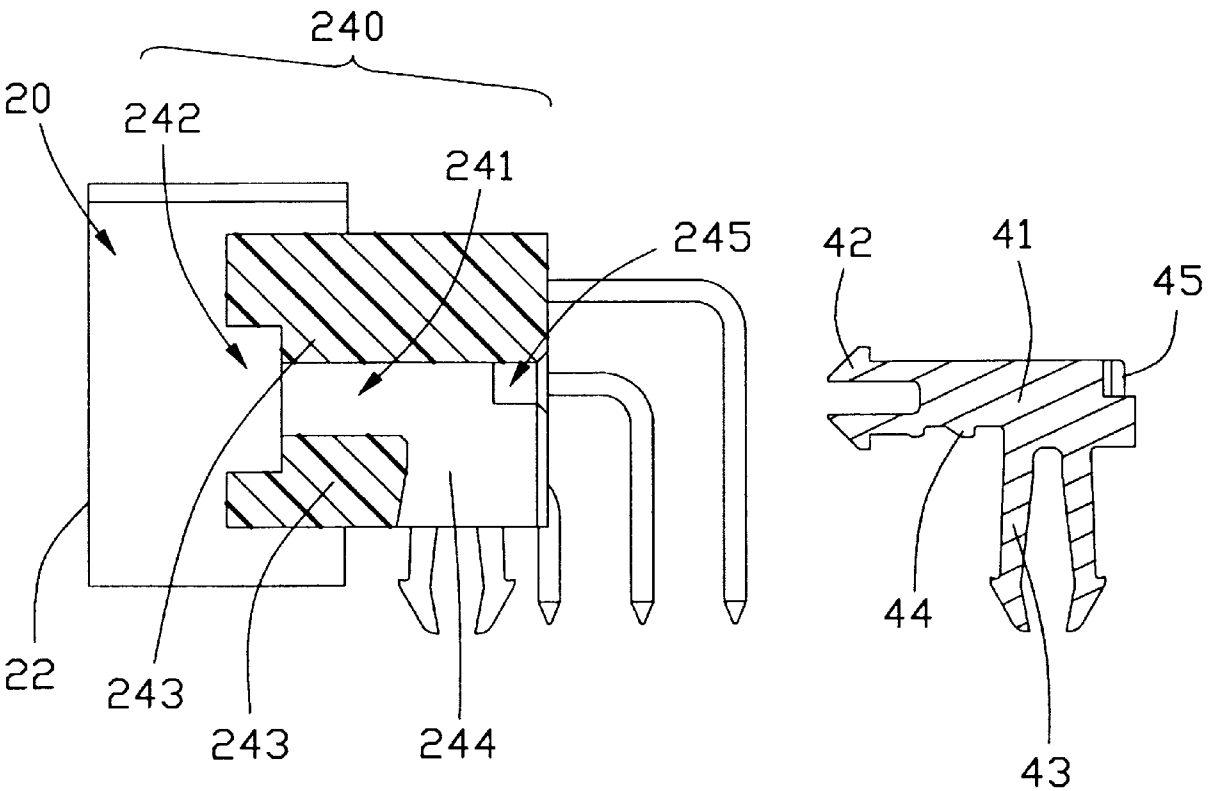
FIG. 6 is a cross-sectional view of the electrical connector taken along line 6—6 of FIG. 3.
Figure 7:
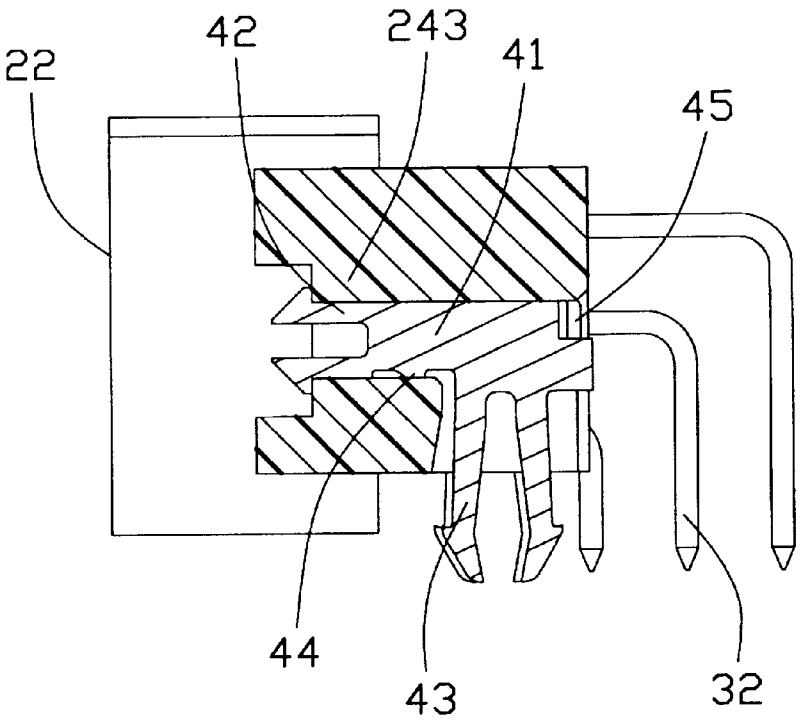
FIG. 7 is a cross-sectional view of the electrical connector taken along line 7—7 of FIG. 5.

Referring to FIGS. 1, 2 and 5, each side portion 24 comprises a receiving space 240 extending along the mating direction and two shoulder portions 243 around the receiving space 240. The receiving space 240 is divided into a first receiving part 241 and a second receiving part 242 by the two shoulder portions 243 and the first receiving part 241 communicates with the second receiving part 242. The side portion 24 further comprises a pair of inner side walls 244, together with the shoulder portions 243, defining the first receiving port 241. Each side portion 24 defines a recess 245 in one side wall 244 adjacent to the rear wall 23 of the housing 20 and communicating with the first receiving part 241.

Referring to FIG. 1, each terminal 30 comprises a mating portion 31 at one end thereof, a solder portion 32 at the other end thereof, and an engaging portion 33 between the mating portion 31 and the solder portion 32.

The pair of board locks 40 have the identical structures. Each board lock 40 comprises a base portion 41, a pair of resilient latch portions 42 extending forwardly from the base portion 41, a pair of leg portions 43 extending downwardly from the base portion 41, a barb 44 formed on the base portion 41, and a positioning bar 45 extending rearwardly from the base portion 41 and offset with the base portion 41.

Referring to FIGS. 3, 4, 5 and 7, in assembly, the terminals 30 are assembled into the housing 20 from the rear wall 23 to the mating face 22 with the mating portions 31 extending into the mating port 21, the engaging portions 33 engaging with the passageways 231, and the solder portions 32 extending outside the housing 20. Each board lock 40 is assembled into the corresponding side portion 24 along a direction opposite the mating direction with the base portion 41 received into the first receiving part 241, the latch portions 42 extending into the second receiving part 242 and abutting against the shoulder portions 243 for preventing the board lock 40 from moving, the barb 44 interfering with one shoulder portion 243, the positioning bar 45 received into the recess 245 for preventing the board lock 40 from moving, and the leg portions 43 extending outside the side portion 24.

Because the mating port 21 and the receiving space 240 are together defined in the mating direction; thus a wedge-shaped slide mold is omitted. The whole height of the molds to form the housing is decreased.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining a mating portion with a pair of side portions, each of said side portions defining a receiving space extending therethrough in a first direction of the corresponding side portion, said receiving space including a first receiving part in a front portion of the corresponding side portion, and a second receiving part in a rear portion of the corresponding side portion, said first receiving part and said second receiving part communicating with each other in the first direction, a recess formed in said rear portion and communicatively located beside said first receiving part transversely in a second direction of the corresponding side portion, said second direction being perpendicular to said first direction, said second receiving pan being dimensionally larger than said first receiving part in a third direction of the corresponding side portion, said third direction being perpendicular to both said first direction and said second direction;

a pair of board locks respectively received within the corresponding receiving spaces, each of said board locks including a base portion received in the corresponding first receiving part, a latching section including a pair of legs extending forwardly from the base portion and latchably received within the corresponding second receiving part, and a positioning bar extending transversely from the base portion and retainably received within the corresponding recess; wherein each of said board locks further includes a board locking section extending downwardly from a bottom of the base portion and in between said latching section and said positioning bar for retaining the connector on a printed circuit board on which the housing is seated; wherein a barb coplanarly extends from a bottom edge of the base portion for reinforcing retention provided by said latching section.

2. The connector as described in claim 1, wherein said board locking section includes a pair of legs extending downwardly beyond a bottom face of the housing.

* * * * *